US007264522B2

(12) United States Patent
Lee et al.

(10) Patent No.: US 7,264,522 B2
(45) Date of Patent: Sep. 4, 2007

(54) CHILDREN'S WATER BOARD WITH MANUALLY-OPERATED SPRAY MECHANISM

(75) Inventors: H. Henry Lee, San Francisco, CA (US); Boguslaw Orlowski, Oceanside, CA (US)

(73) Assignee: Wham-O, Inc., Emeryville, CA (US)

( * ) Notice: Subject to any disclaimer, the term of this patent is extended or adjusted under 35 U.S.C. 154(b) by 0 days.

(21) Appl. No.: 11/057,305

(22) Filed: Feb. 11, 2005

(65) Prior Publication Data

US 2005/0202738 A1 Sep. 15, 2005

Related U.S. Application Data

(60) Provisional application No. 60/544,786, filed on Feb. 13, 2004.

(51) Int. Cl.
*B63B 1/00* (2006.01)

(52) U.S. Cl. ..... 441/65

(58) Field of Classification Search ..... 440/39; 441/65, 129, 130, 131
See application file for complete search history.

(56) References Cited

U.S. PATENT DOCUMENTS 4,115,888 A * 9/1978 Sievers ..... 440/38
5,167,554 A * 12/1992 Tager et al. ..... 441/131
6,027,393 A * 2/2000 O'Rourke ..... 446/153
6,257,944 B1 * 7/2001 Herrod ..... 441/130

* cited by examiner

*Primary Examiner*—Stephen Avila
(74) *Attorney, Agent, or Firm*—Kolisch Hartwell, P.C.

(57) ABSTRACT

A water board for use by a child or young person for play in the water includes a board-mounted spray mechanism manually-operable for enabling the rider to selectively spray metered amounts of water outwardly from a barrel mounted on the spray mechanism.

17 Claims, 4 Drawing Sheets

CHILDREN'S WATER BOARD WITH MANUALLY-OPERATED SPRAY MECHANISM

CROSS-REFERENCE TO RELATED APPLICATION

This application claims priority to U.S. Provisional Patent Application Ser. No. 60/544,786, filed Feb. 13, 2004, the disclosure of which is incorporated herein by reference.

SUMMARY OF THE INVENTION

The present invention relates to children's toys, and more particularly to a novel board, similar in size to a kickboard for use in a swimming pool or lake, which is provided with a manually-operable spray mechanism. The board can be used by a child or young person for paddling around in the water, and the board-mounted spray mechanism is manually-operable for enabling the rider to selectively spray metered amounts of water outwardly from a barrel mounted on the spray mechanism. The spraying action enables the child paddling around on the board to play with other children, by spraying them with water thereby to enhance play value of a kickboard.

DETAILED DESCRIPTION OF THE PREFERRED EMBODIMENT

Figure 1A:
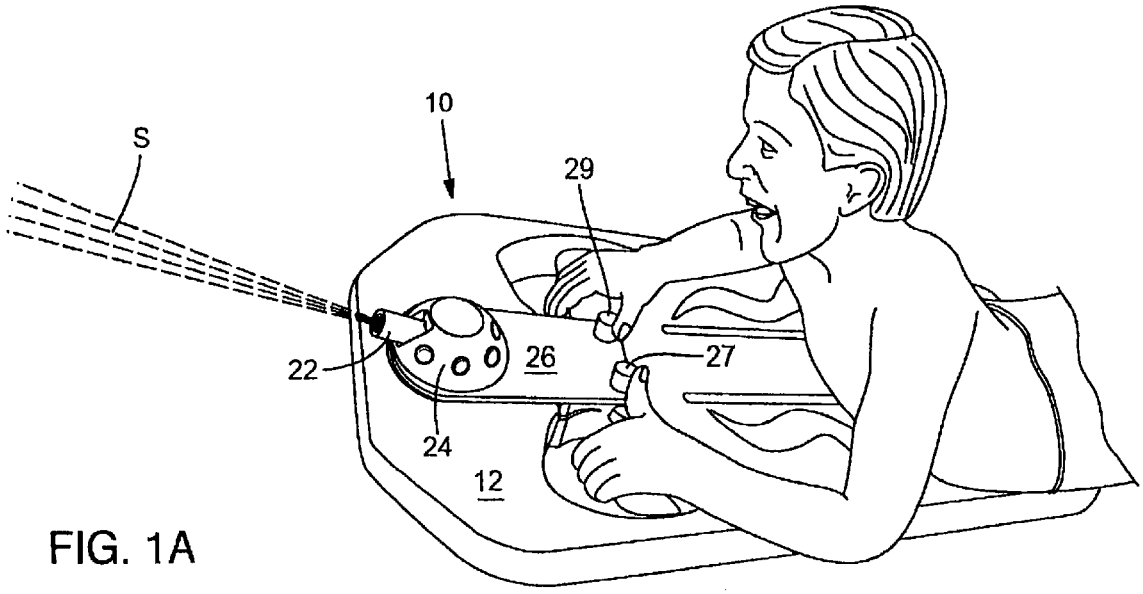
FIG. 1A is a perspective view, showing a child using the board of the present invention to spray water from a nozzle or barrel mounted on front of the board.
Figure 1B:
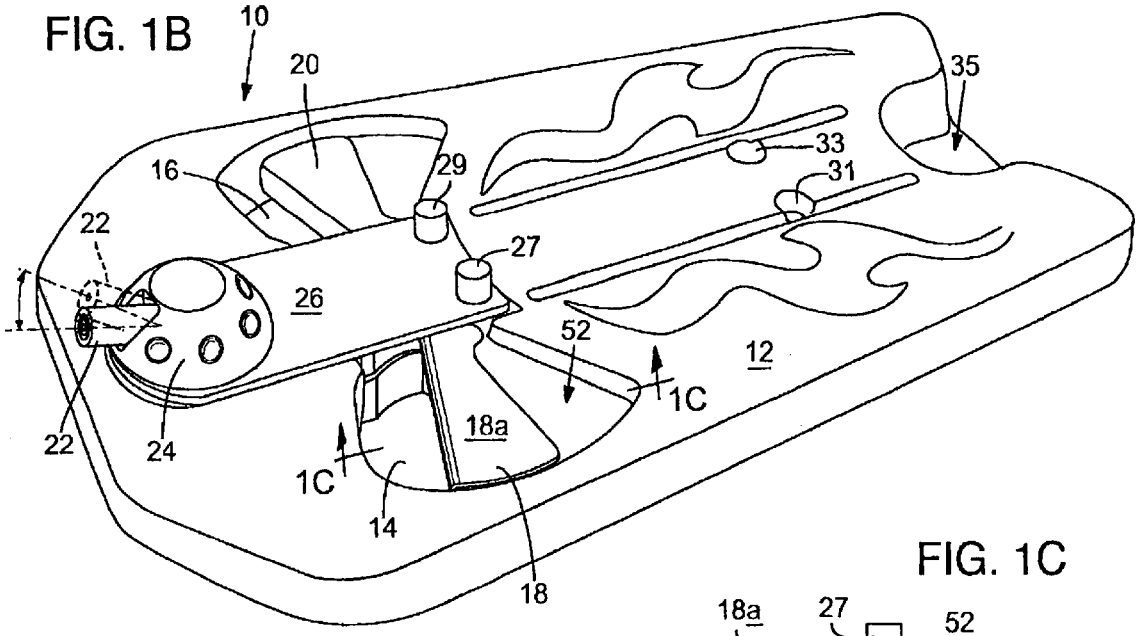
FIG. 1B is a perspective view of the board of the present invention.
Figure 1C:
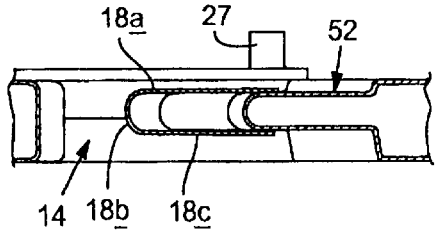
FIG. 1C is a view taken along lines C-C of FIG. 1B.
Figure 2:
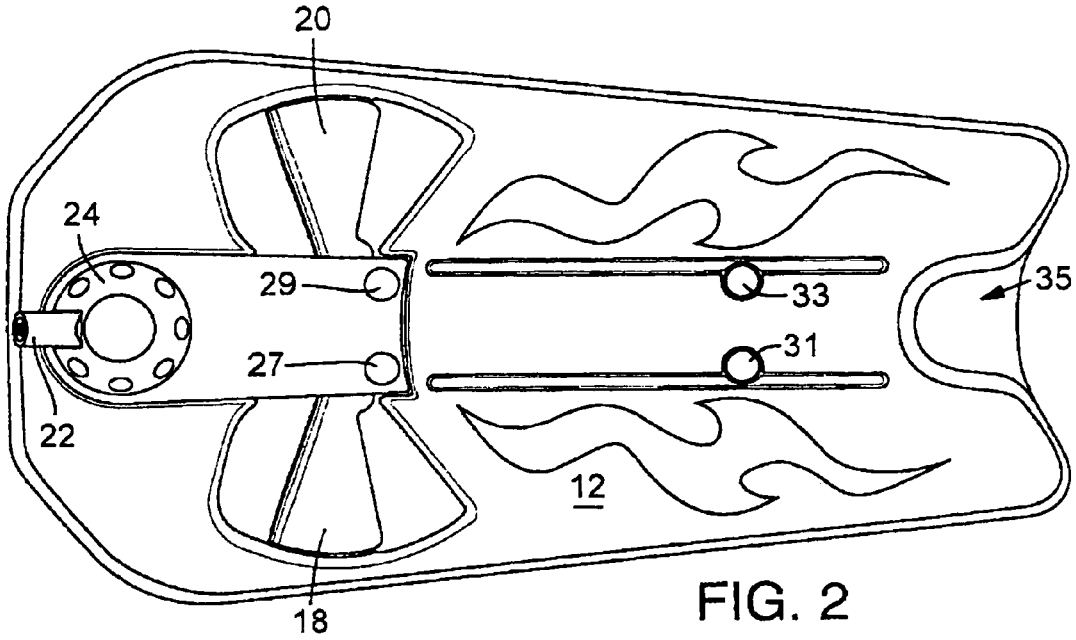
FIG. 2 is a top plan view of the board of the present invention.

As shown in FIG. 1A, a paddle or kickboard is generally indicated at 10, shown with a young person riding the board in water, and pulling or actuating triggers for ejecting water spray, generally indicated at S, originating from water drawn from a pool in which the child is paddling. As shown in FIG. 1B, board 10 is shown without the child riding, and features of the board are as follows. The board includes a top surface 12 spaced apart from a bottom surface 13 (see FIG. 3), so that the bulk of the board, formed of molded plastic material, is essentially hollow between its top and bottom surfaces. The board includes spaced-apart, laterally positioned openings 14, 16 formed within the board which enable mounting of pivotal handles or triggers, a left one being shown at 18 and a right one being shown at 20. The triggers are deployed by actuating valves to permit water to be drawn from the pool, or lake as the case may be, and ejected or sprayed under pressure from a barrel, such as indicated at 22. As shown in FIG. 1B, barrel 22 is pivotally mounted within a dome-like structure 24 which is in turn mounted on an upper plate 26. Positioned on the bottom of the board is a lower plate which is connected to the upper plate, and both the plates provide a mounting for a pump assembly as will be described. The pump assembly is mounted within a cavity formed between the top and bottom surfaces.

Figure 3:
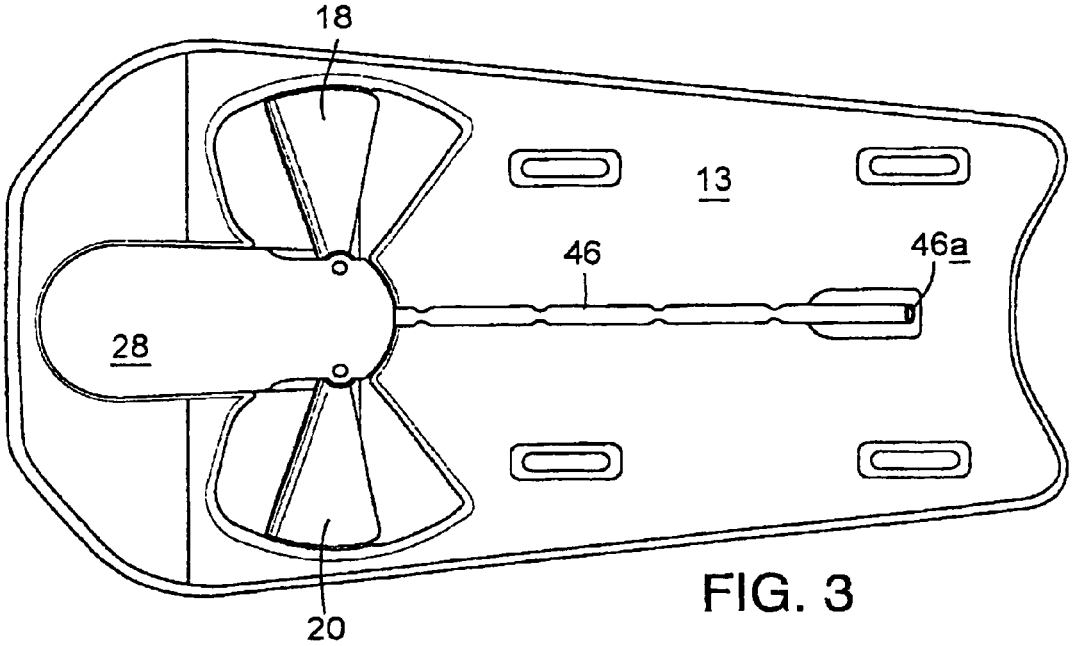
FIG. 3 is a bottom plan view of the board of the present invention.
Figure 4:
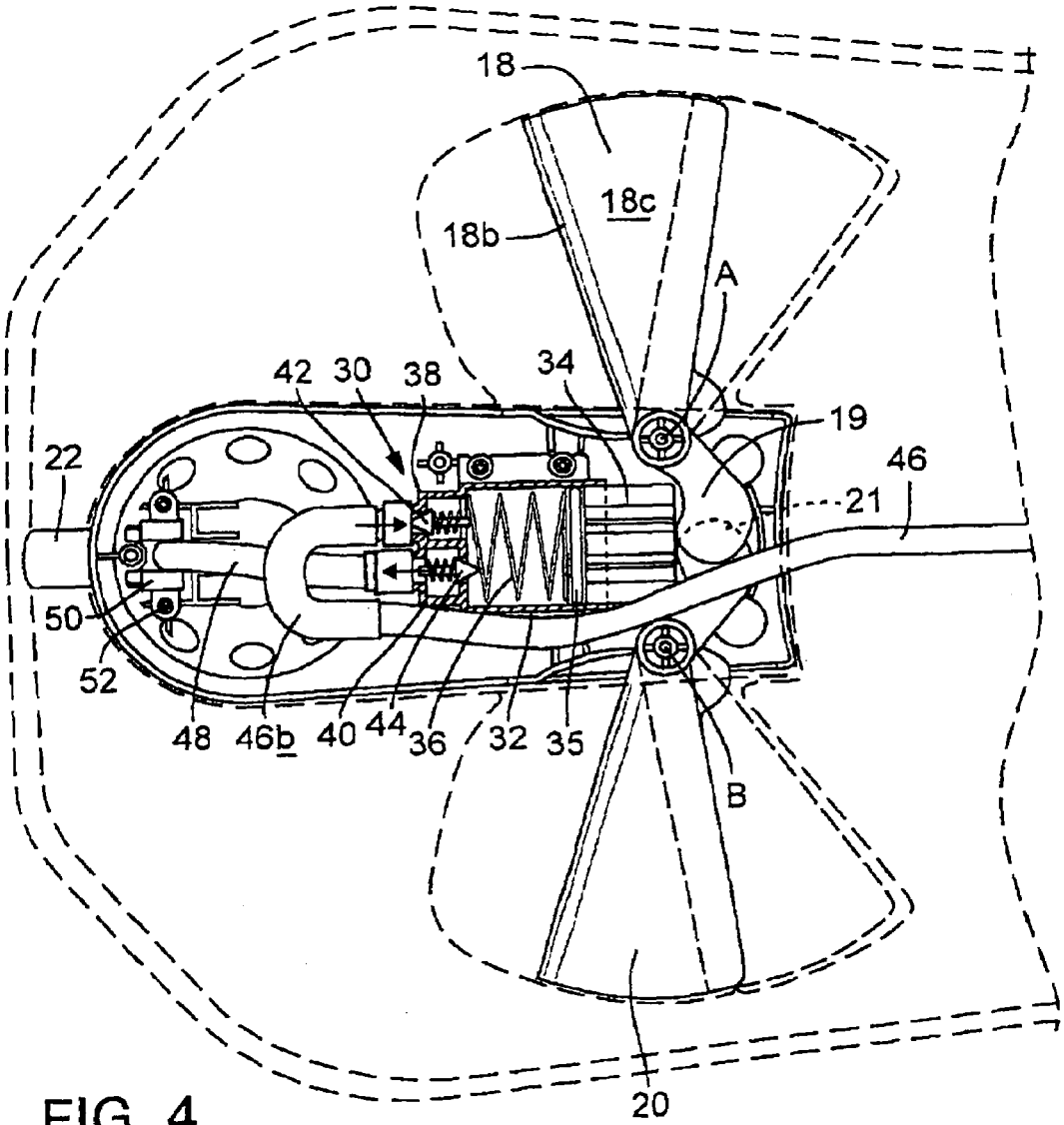
FIG. 4 is a bottom view, with portions of the spray assembly and pump mechanism cut away.

As shown in FIG. 3, a bottom plate is shown at 28, and as shown in FIG. 4, with bottom plate 28 removed, and with parts sectioned away, details of a spraying mechanism can be appreciated. Specifically, a spray/pump assembly is generally indicated at 30, and includes a cylinder 32 (shown in cross section) in which is mounted a piston 34 normally biased by a compression spring 36 into the retracted position shown in FIG. 4. Extending from the upper portion of cylinder 32 are water inlet and outlet chambers, indicated at 38, 40, respectively. Mounted within inlet chamber 38 is a spring-biased one-way valve 42, for permitting entry of water into the cylinder. Mounted within outlet chamber 40 is a spring-biased one-way valve 44 for permitting water to be propelled outwardly therefrom upon extension of piston 34 into cylinder 32.

Figure 5:
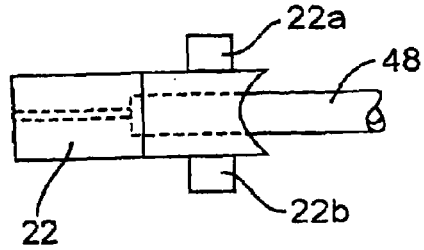
FIG. 5 is an enlarged view of the barrel.

It will be noted that an elongate, flexible tube or hose, indicated at 46 (see also FIG. 3) extends alongside the bottom of the board, and is provided with an opening 46*a* so that water may be drawn from the pool and directed toward inlet chamber 38 upon retraction of piston 34, relative to the cylinder. Extending from outlet chamber 44 is a tube 48 which extends through a bracket 50 and is connected to barrel 22. As can be seen, bracket 50 is secured by fasteners, such as indicated at 52, to the bottom portion of dome 24. As shown in FIG. 5, barrel 22 includes ears, such as indicated at 22*a* and 22*b* which are mounted within portions of the dome, on the underside thereof, so that barrel 22 may be pivoted to a desired angular position, relative to the board, as shown in FIG. 1B.

As shown in FIG. 4, piston 34 is normally retracted or biased rearwardly by spring 36, and triggers 18 and 20 are pivotally mounted so that when they are pulled rearwardly, they engage and actuate piston 34 to extend into the cylinder so that it compresses spring 36 and forces water from the interior of chamber 32 so that it compresses the spring of outlet valve 40 and ejects or propels water through tube 40 and barrel 22 for outward spraying. The construction of each of the triggers is essentially the same, and a description of trigger 18 will be set forth. As shown in FIG. 1B, trigger 18 includes a planar top surface 18 which transitions forwardly to a curved, forward edge 18*b* to a planar bottom surface 18*c*. The space between surfaces 18*a*, 18*b* is sufficient to permit the trigger to be shifted rectilinearly over an extension or guide 52, having upper and lower surfaces dimensioned so that when trigger 18 is retracted, it will slide over the guide smoothly and will prevent the trigger from wobbling. As shown in FIG. 4, trigger 18 is pivotally connected to plate 26 so as to rotate about a vertical axis A, which, when the trigger is pulled rearwardly, i.e., to the right as shown in FIG. 4, a lug 19, which normally engages the bottom of piston 34, will direct piston 34 to the left to cause the ejection of water. The construction of trigger 20 is similar to that of trigger 18, and trigger 20 also pivots, about vertical axis B, and slides over a guide, and is provided with a lug 21 which is positioned on the opposite side of lug 19, so that when both triggers are pulled, they both exert a force against piston 34.

It will be noted from a viewing of FIG. 1B, that thumb grips for the left and right hand are shown at 27, 29, respectively, so that when a rider grips the handles, the thumbs may be placed against the thumb grips to provide support when the triggers are pulled against the force exerted by compression spring 36. It will also be noted that a pair of spaced-apart apertures 31, 33 are positioned rearwardly of extensions or grips 27, 29, and an open area, provided as a recess generally indicated at 35, is formed in a rear portion of the board. Openings 31, 33 and the recess are provided to facilitate nesting of a pair of boards to facilitate compact shipment. More specifically, if another board, substantially identical to board 10 shown in FIG. 1B, is mounted so that its top surface faces downwardly, to orient its dome and trigger to be positioned within recess area 35, then the finger grips will be insertable into apertures 31, 33. Similarly, dome 24 and trigger 22 of the board shown in FIG. 1B, will be nested within the rear recess of the board positioned on top. The net result is a low profile two-board arrangement which facilitates shipping.

OPERATION OF THE SPRAY MECHANISM DURING PLAY

When it is desired to play with the board in a body of water, such as a pool or lake, a child or young person merely mounts onto the board as one would do any conventional paddleboard or kickboard, i.e., with a portion of the upper torso positioned against the upper surface of the board, and the trunk and legs trailing behind to enable kicking. The young person grips triggers 18 and 20, with the left and right hands, respectively, and the thumbs may be placed against the thumb grips. Then, by paddling around, either or both of the triggers may be pulled or retracted, so that piston 34 is extended inwardly so that its head 35 presses against spring 36 to force or propel water from inside the cylinder through chamber 40, outwardly through tube 48 and for propulsion through barrel 22. When hand pressure on the triggers is relaxed, the triggers are permitted to move forwardly, by action of compression spring 36, and water is drawn through opening 46*a* and through tubes 46 and 46*b* against the spring action of inlet valve 42 so that the interior of cylinder 32 is filled with water. Again, by actuating one or both of the triggers, spring action may be selectively provided by the young person paddling around on the board. The simplicity of the trigger action, with rotation around axes A and B, enables the young rider to rapidly deploy and release the triggers to propel or eject water from cylinder 32 and to refill it quickly. Depending upon how quickly the triggers are actuated, water can be propelled and sprayed rapidly, providing significant play value.

As mentioned previously, barrel 22, provided with the ears such as shown at 22*a*, 22*b* in FIG. 5, may be selectively positioned for providing a desired angle, relative to the planar, upper surface of board 10. Thus, a child may preselect how far in the air the spray is to be directed, i.e., to playmates which are close or further away in the pool or other body of water. The spray which is ejected from barrel 22, by selective and repeated action of the triggers when pulled or deployed, is one which is not harmful to children and which provides amusing play value; target children can seek to escape from the spray, while the child with the board paddles around in mock pursuit. Likewise, a group of children may be provided with the boards and have simulated battles, provided by spraying water on one another.

We claim:

1. A water board for use in a body of water, comprising:

a top surface;

a bottom surface spaced apart from the top surface; and a manually-operable spraying mechanism configured to draw from the body of water and to eject water, wherein at least a portion of the spraying mechanism is disposed between the top surface and the bottom surface; wherein the spraying mechanism includes at least one trigger connected to the top surface and disposed in a plane substantially parallel to the to surface, the trigger configured to pivot about an axis substantially perpendicular to the top surface to actuate the spraying mechanism.

2. The water board of claim 1, wherein the spraying mechanism is configured to eject water when the user deploys the at least one trigger.

3. The water board of claim 2, wherein the spraying mechanism is configured to draw water from the body of water when the user releases the at least one trigger.

4. The water board of claim 1, further comprising at least one opening formed within the board, wherein the at least one trigger is disposed within the at least one opening.

5. The water board of claim 1, wherein the spraying mechanism includes at least one grip configured to provide support to the user when the at least one trigger is deployed.

6. The water board of claim 1, wherein the spraying mechanism includes a barrel configured to direct the ejected water and configured to be adjustable to a desired angular position relative to the board.

7. The water board of claim 1, wherein the top surface includes at least one aperture configured to receive a first portion of a spraying mechanism of another water board.

8. The water board of claim 7, wherein the top surface includes at least one recess configured to receive a second portion of the spraying mechanism of that another water board.

9. A water board for use in a body of water, comprising:

a top surface having an upper plate;

a bottom surface having a bottom plate; and a spraying mechanism configured to draw from the body of water and to propel water, comprising:

a spray assembly disposed between the upper plate and the bottom plate, wherein the spray assembly is configured to draw from the body of water and to propel water;

a barrel disposed on the upper plate and configured to direct the propelled water; and a first trigger disposed within a first opening in the board and configured to be pulled and to be released by a user.

10. The water board of claim 9, wherein the barrel is configured to be pivotable to a desired angular position relative to the board.

11. The water board of claim 9, wherein the spray assembly is configured to propel water from the barrel when the user pulls the first trigger, and to draw from the body of water when the user releases the first trigger.

12. The water board of claim 9, further comprising a first grip disposed on the upper plate, wherein the grip is configured to provide support to the user when the first trigger is pulled.

13. The water board of claim 9, wherein the spraying mechanism includes a second trigger disposed within a second opening in the board and configured to be pulled and to be released by the user.

14. The water board of claim 13, wherein the spray assembly is configured to propel water from the barrel when the user pulls at least one of the first trigger and the second trigger.

15. The water board of claim 14, wherein the spray assembly is configured to draw from the body of water when the user releases at least one of the first trigger and the second trigger.

16. The water board of claim 13, further comprising a second grip disposed on the upper plate and configured to provide support to the user when the second trigger is pulled.

17. The water board of claim 16, further comprising two apertures configured to receive at least first and second grips of another board, and a recess configured to receive at least a barrel of that board.

* * * * *